United States Patent [19]

Reichert et al.

[11] 4,158,757

[45] Jun. 19, 1979

[54] ENCLOSURE SEAL

[75] Inventors: Gilbert A. Reichert, Greendale; Dennis J. Trendel, Mukwonago, both of Wis.

[73] Assignee: Allen-Bradley Company, Milwaukee, Wis.

[21] Appl. No.: 877,847

[22] Filed: Feb. 15, 1978

[51] Int. Cl.[2] ..... H01H 9/04; F16J 15/32

[52] U.S. Cl. ..... 200/302; 174/52 R; 277/166; 277/211; 277/235 R

[58] Field of Search ..... 174/52 R, 53, 66; 200/293, 302; 277/166, 235 R, 206, 207 R, 211, 235 B

[56] References Cited

U.S. PATENT DOCUMENTS

| | | | |
|---|---|---|---|
| 3,038,054 | 6/1962 | Naimer | 200/302 |
| 3,195,906 | 7/1965 | Moyers | 277/211 X |
| 3,392,228 | 7/1968 | Zerwes | 174/52 R |
| 3,448,986 | 6/1969 | Jelinek et al. | 277/211 X |
| 3,578,346 | 5/1971 | Jelinek | 277/211 X |
| 3,863,936 | 2/1975 | Farnam et al. | 277/166 |
| 3,874,675 | 4/1975 | Belter et al. | 277/235 B X |
| 3,930,656 | 1/1976 | Jelinek | 277/166 X |
| 3,939,896 | 2/1976 | Farnam et al. | 277/166 X |
| 4,026,565 | 5/1977 | Jelinek | 277/235 B X |

*Primary Examiner*—Robert S. Ward, Jr.
*Attorney, Agent, or Firm*—Quarles & Brady

[57] ABSTRACT

A seal for an enclosure of electrical equipment includes a metal frame which is clamped between sealing surfaces on the enclosure base and the enclosure cover. A ring of elastomeric material is molded around the outer edge of this frame and raised beads thereon are compressed by the sealing surfaces on the enclosure base and cover to provide a seal around the outer periphery of the enclosure.

10 Claims, 5 Drawing Figures

25
41
24
26
23
12
27
30
33
31
28
29
42
11
43
22
18
17
20
15
13
21
14
16
19
10

ENCLOSURE SEAL

BACKGROUND OF THE INVENTION

The field of the invention is enclosures for electrical equipment, and particularly, enclosures which seal electrical equipment from the surrounding environment.

There are numerous applications where electrical devices such as switches, relays and terminal blocks must be sealed off from the surrounding environment. Such seals may, for example, exclude liquids such as water where the equipment is exposed to the weather or it may inhibit the passage of gases where the equipment is exposed to volatile vapors. Standards have been established for seals of various types and it is, of course, an objective in the art to meet these standards with any proposed structure.

Standards for sealed enclosures may take the form of specific structural requirements or they make take the form of performance requirements. One such structural standard requires that the juncture between two parts of an enclosure be formed by metal against metal, with the metal having a specified width. On the other hand, to meet certain performance standards it has been found that rings of elastomeric material must be used at the junction of two enclosure parts.

Although prior enclosures are typically designed to meet a specific standard, there are some enclosures available which meet more than one standard. One such enclosure, for example, provides a wide metal flange at the juncture of its base and cover with a rubber O-ring clamped between the mating flange surfaces. To provide the required width of metal-to-metal contact to meet the above structural standard and at the same time to provide the additional surface area in which to clamp the rubber O-ring, a very thick and costly flange is necessary.

SUMMARY OF THE INVENTION

The present invention relates to an improved seal for an enclosure. It includes an elastomeric ring which is formed around the outer edge of a metal frame that is disposed between the sealing surfaces on the enclosure cover and enclosure base. The metal frame provides a "metal-to-metal" seal with the sealing surfaces on the enclosure base and cover and the elastomeric ring includes oppositely directed beads which are compressed by the sealing surfaces to provide an "elastomeric" seal around the outer periphery of the enclosure.

A general object of the invention is to provide a metal-to-metal seal and an elastomeric seal for an enclosure of electrical equipment. The metal frame is a relatively thin plate-like structure having a pair of oppositely facing sealing surfaces bounded by an inner edge which communicates with the enclosure cavity and an outer edge which communicates with the surrounding environment. The width of these sealing surfaces is determined by the applicable standard and they mate with the sealing surfaces on the enclosure base and cover to provide the desired metal-to-metal seal. The sealing surfaces on the enclosure base and cover extend very slightly beyond the outer edge of the frame and the elastomer ring which is molded onto this outer edge is compressed between these surfaces to provide an elastomeric seal around the periphery of the enclosure.

An object of the invention is to provide an elastomeric seal without appreciably increasing the size of the enclosure. This is accomplished by molding the elastomer ring on the outer edge of the rigid frame rather than on its oppositely directed surfaces. As a result, nearly the entire width of the frame is employed to provide the metal-to-metal seal and only a very small portion at its outer extent is employed to retain the elastomer ring.

Yet another object of the invention is to facilitate the addition of an elastomeric seal to an enclosure with a metal-to-metal seal. The sealing surfaces on the enclosure are typically flat so that they tightly mate with one another when the top is fastened directly to the base to provide a metal-to-metal seal. If an elastomeric seal is also required for a particular installation, the seal of the present invention may be employed by inserting it between the enclosure's sealing surfaces. No other modification to the enclosure is needed and wide flanges need not be formed on the enclosure to accommodate the elastomeric seal.

A more specific object of the invention is to securely mold the elastomer ring to the outer edge of the metal frame. The outer edge of the metal frame is contoured to form a pair of recesses into which the molded elastomer flows. A pair of oppositely directed beads formed by the elastomer are disposed in the plane of these recesses and they extend completely around the periphery of the seal. The beads extend through the planes defined by the respective sealing surfaces on the frame to engage the respective sealing surfaces on the enclosure base and cover.

The foregoing and other objects and advantages of the invention will appear from the following description. In the description reference is made to the accompanying drawings which form a part thereof, and in which there is shown by way of illustration a preferred embodiment of the invention. Such embodiment does not necessarily represent the full scope of the invention, however, and reference is therefore made to the claims herein for interpreting the scope of the invention.

DESCRIPTION OF THE PREFERRED EMBODIMENT

Figure 1:
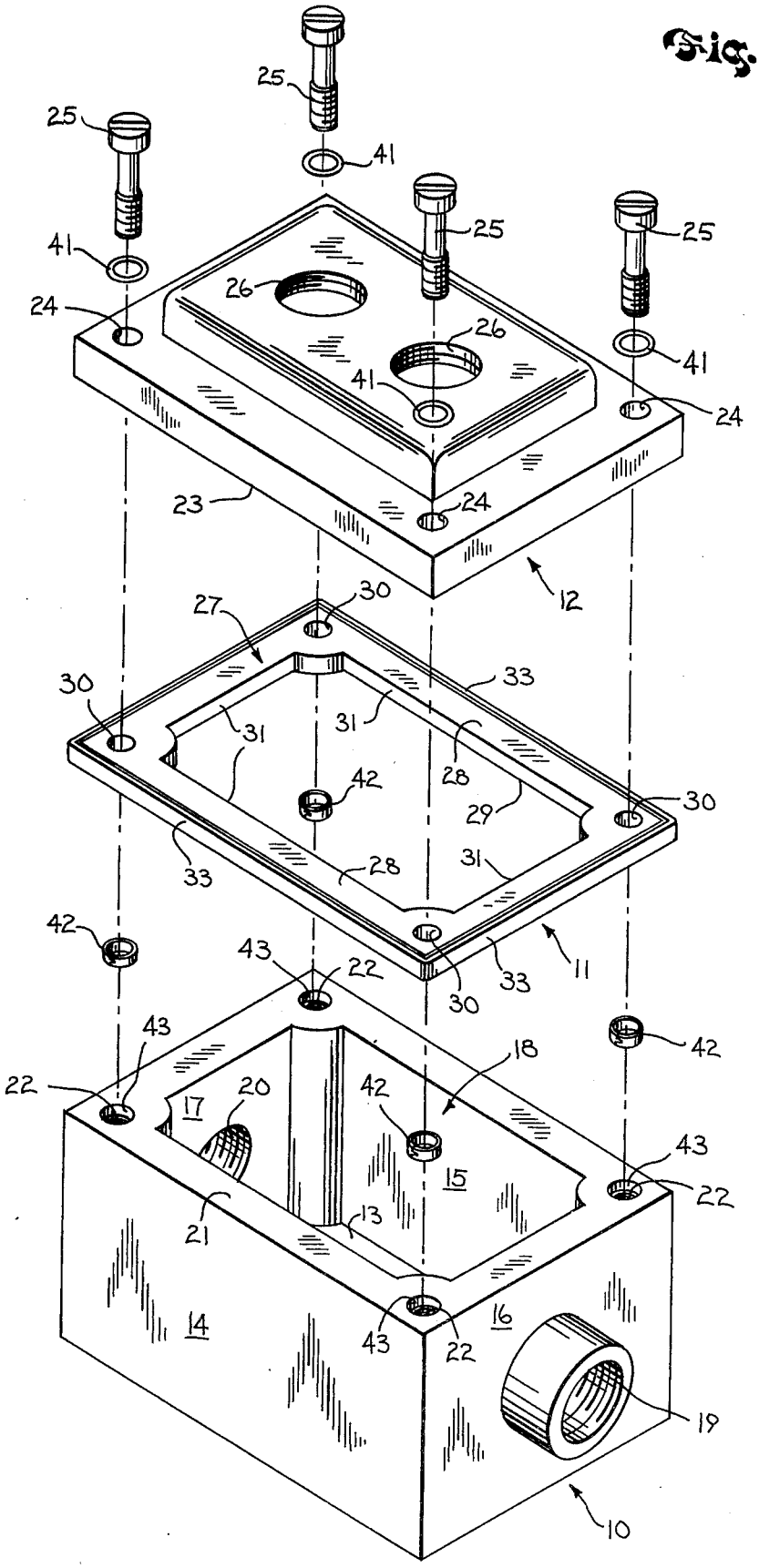
FIG. 1 is an exploded perspective view of an enclosure which employs the seal of the present invention.
Figure 2:
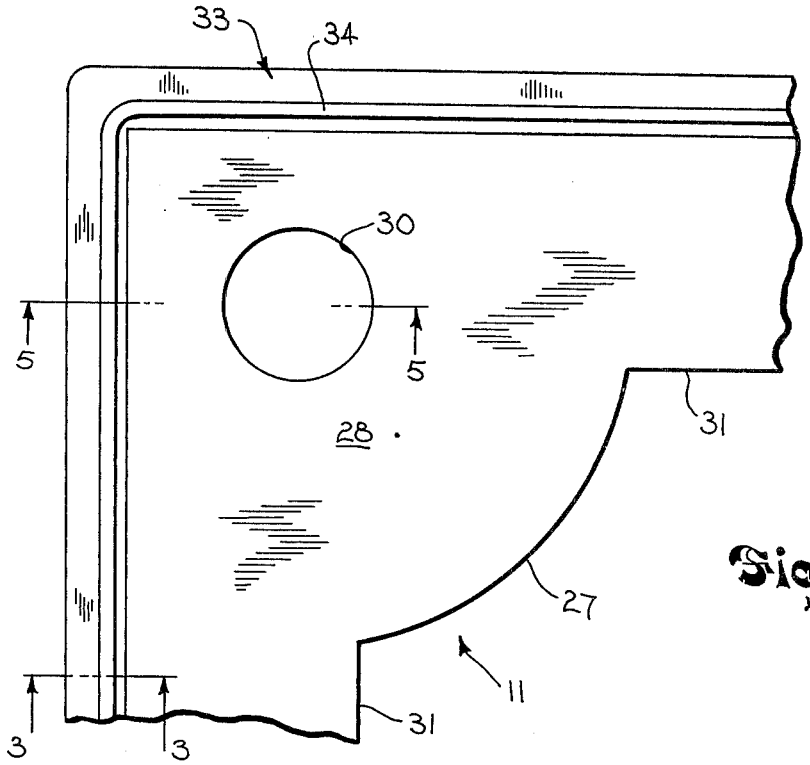
FIG. 2 is a partial top view of the invented seal.

Referring to FIG. 1, an enclosure for a pushbutton switch or the like includes a base 10, a seal 11 and a cover, or top 12. The base 10 is cast from aluminum and it includes a bottom 13 and four upright walls 14–17 which define a cavity indicated at 18. The pushbutton switch or other electrical device is mounted within the cavity 18 and it is connected to other devices (not shown in the drawings) through openings 19 and 20 formed in the end walls 16 and 17. The top edges of the walls 14–17 are machined to form a flat sealing surface 21 which extends completely around the cavity 18. Threaded openings 22 are formed in the base 10 at each of its corners.

Figure 4:
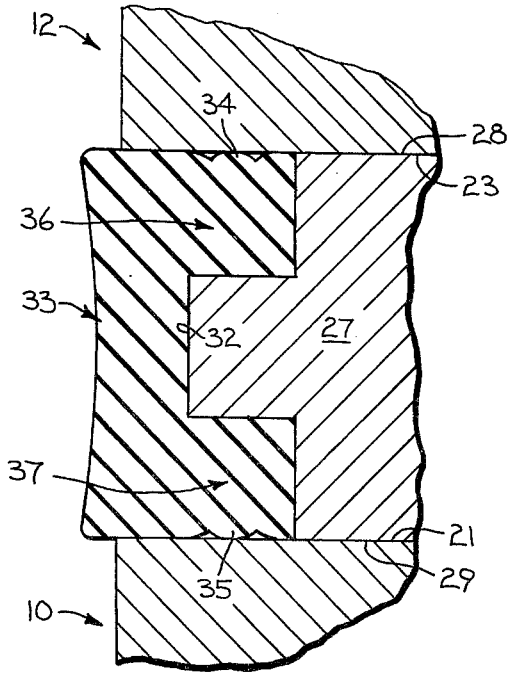
FIG. 4 is a view in cross section as in FIG. 3 with the seal fastened in place between the sealing surfaces of the enclosure.

Referring particularly to FIGS. 1 and 4, the rectangular cover 12 is also cast from aluminum. It is machined on its underside to form a flat sealing surface 23 which mates with the sealing surface 21 on the base 10. Four openings 24 are formed in the cover 12 at each of its corners and these are in alignment with the threaded openings 22 in the base 10. Bolts 25 are inserted through these openings 24 to fasten the top 12 to the base 10. Large threaded openings 26 are also formed in the cover 12 along its center line for mounting an electrical device and allowing passage of its shaft or other element to the exterior.

The top 12 may be fastened directly to the base 10 with the sealing surfaces 21 and 23 in mating engagement with each other. A metal-to-metal seal is thus formed with the thickness of the walls 14–17, and hence the width of the sealing surfaces 21 and 23 selected to meet the applicable standard for this type of seal. For many uses the metal-to-metal seal is sufficient and the seal now to be described is not needed.

Referring to FIGS. 1–4, the seal 11 includes an aluminum frame 27 which has a rectangular shape and which is dimensioned slightly smaller than the outer dimensions of the sealing surfaces 21 and 23. The frame 27 is machined on both sides to form flat sealing surfaces 28 and 29 which engage and mate with the respective sealing surfaces 23 and 21 when fastened in place between the base 10 and top 12. Openings 30 are formed through the frame 27 at each of its corners and they are aligned with the threaded openings 22 in the base 10 and the openings 24 in the cover 12 to allow passage of the bolts 25.

Figure 3:
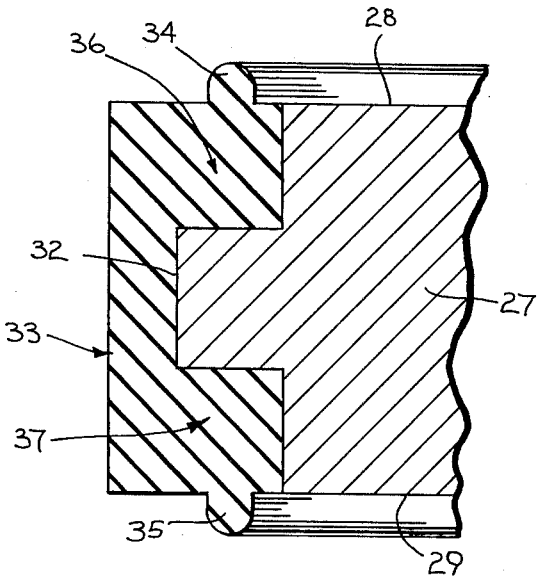
FIG. 3 is a view of cross section taken along the line 3—3 through the seal of FIG. 2.

As shown best in FIGS. 3 and 4, the oppositely directed sealing surfaces 28 and 29 on the seal 11 are bounded on one side by an inner edge 31 which communicates with the cavity 18 and which is substantially flush with the interior surface of the base 10. The sealing surfaces 28 and 29 are bounded on their other side by an outer edge 32 which extends completely around the enclosure and which is inset slightly from the outer surfaces of the base 10 and cover 12. A ring 33 made of an elastomeric material is molded on this outer edge 32 and it includes a pair of beads 34 and 35 which are oppositely directed and which extend through the planes defined by the respective sealing surfaces 28 and 29 to engage the sealing surfaces 23 and 21 on the enclosure cover 12 and base 10. The beads 34 and 35 extend completely around the periphery of the enclosure and when the seal 11 is tightly fastened in place between the base 10 and cover 12, the beads 34 and 35 are compressed by the sealing surfaces 21 and 23 to provide an elastomeric seal around the enclosure cavity 18.

The outer edge 32 of the frame 27 is contoured to improve adhesion between it and the elastomer ring 33. More particularly, the frame 27 is dadoed around its outer edge 32 on both sides to form rectangular recesses 36 and 37 into which elastomeric material flows during the molding process. The beads 34 and 35 are formed inward from the remaining outermost edge 32 and they are aligned in a common place with the recesses 36 and 37. As a result, the fastening force generated by bolts 25 "pinch" the upper and lower edges of the ring 33 to hold it securely in place as shown in FIG. 4.

The ring 33 may be formed from an elastomeric material such as neoprene rubber. The particular material chosen is usually dictated by the proposed end use of the enclosure. For example, use of the enclosure in the petrochemical industry might suggest a fluorocarbon rubber, whereas a silicone rubber might be more appropriate if the enclosure is to be subjected to relatively high temperatures.

Although various sized and shaped rings 33 are possible, a ring 33 having beads 34 and 35 with a diameter in the range of 0.015 to 0.035 inches is preferred regardless of the size of the enclosure. Reliability of the seal has been found to decrease with beads of smaller diameter and beads of larger diameter do not significantly improve performance.

Figure 5:
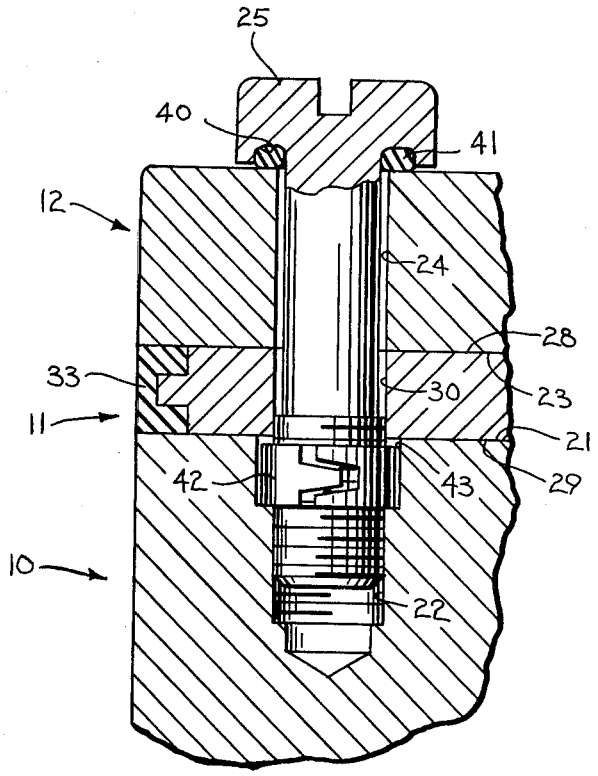
FIG. 5 is a partial view in cross section through the assembled enclosure taken along the line 5—5 shown in FIG. 2.

Referring particularly to FIG. 5, when the seal of the present invention is employed measures must be taken to provide an elastomeric seal around the bolt openings 24 in the cover 12. Accordingly, an annular recess 40 is formed beneath the head of each bolt 25 and an elastomer O-ring 41 is disposed therein around the shank of the bolt 25. When the bolt 25 is tightly fastened, this O-ring 41 is compressed against the surface of the cover 12 to provide a seal around the opening 24. To insure that this sealing arrangement is not mistakenly omitted when the user disassembles the enclosure, a retainer spring 42 is disposed around the bolt shank beneath the seal 11. When the enclosure is assembled, this retainer 42 lies in a recess 43 formed in the base 10 around each threaded opening 22. When the cover 12 is removed, the retainer 42 prevents the seal 11 and bolts 24 from becoming separated.

It can be appreciated that the size and shape of the enclosure can vary considerably from that disclosed herein. The invented seal 11 may therefore take a corresponding number of sizes and shapes. In any case, however, the present invention provides a substantial metal-to-metal seal around the enclosure adjacent to the enclosure cavity, and it provides an elastomeric seal around the outer periphery of the enclosure. The elastomer ring is formed on the outer edge of the seal frame with the result that very little additional sealing surface area need be added to that required for the metal-to-metal seal.

We claim:

1. An enclosure for an electrical device, the combination comprising:

a base having a bottom and upright walls which define a cavity for receiving the electrical device;

a first sealing surface formed on said upright walls and encircling said cavity;

a cover having a second sealing surface which opposes said first sealing surface when said cover is positioned in place over said cavity;

a seal disposed between said opposing first and second sealing surfaces, said seal including a frame having an inner edge which encircles said cavity and an outer edge which extends around the periphery of the enclosure, said seal also including a ring formed on the outer edge of said frame from an elastomeric material, which ring includes oppositely directed beads that bear against the respective first and second sealing surfaces when the cover is fastened in place over said cavity.

2. The enclosure as recited in claim 1 in which the first and second sealing surfaces are flat and said frame has oppositely directed flat sealing surfaces which engage and mate with the respective first and second sealing surfaces.

3. The enclosure as recited in claim 2 in which said base, cover and frame are constructed of metal.

4. The enclosure as recited in claim 1 in which a pair of recesses are formed around the outer edge of said frame for receiving said ring and the oppositely directed beads are disposed adjacent the respective recesses and inward from the outermost portion of the frame.

5. The enclosure as recited in claim 2 in which a first recess is formed in said frame around its periphery at the juncture of its outer edge and one of its sealing surfaces and a second recess is formed in said frame around its periphery at the juncture of its outer edge and the other of its sealing surfaces, and wherein said ring is shaped to fill said recesses.

6. The enclosure as recited in claim 5 in which said oppositely directed beads are disposed over said respective recesses and inward from the outer edge of said frame.

7. The enclosure as recited in claim 1 in which a set of bolts extend through aligned openings formed in the cover and seal to engage threaded openings in the base and an elastomer seal is provided around each of said openings in the cover.

8. A seal for an enclosure which has a pair of opposing flat sealing surfaces that encircle a cavity, the combination comprising:

a metal frame having a pair of oppositely directed flat sealing surfaces which are bounded on one side by an inner edge that encircles the enclosure cavity and which are bounded on the other side by an outer edge; and a ring of elastomeric material molded to the outer edge of said metal frame and including a pair of oppositely directed beads, one of which extends above the plane defined by one of said pair of oppositely directed flat sealing surfaces and the other of which extends above the plane defined by the other of said pair of oppositely directed flat sealing surfaces.

9. The enclosure seal as recited in claim 7 in which the outer edge of said metal frame is contoured to form a pair of recesses, one associated with each of said pair of oppositely directed flat sealing surfaces and said molded ring fills said recesses.

10. The enclosure seal as recited in claim 8 in which said oppositely directed beads are disposed in a common plane with said recesses and this common plane is disposed inward from the outermost edge of said metal frame.

* * * * *